US012663159B2

(12) United States Patent
Jang et al.

(10) Patent No.: US 12,663,159 B2
(45) Date of Patent: Jun. 23, 2026

(54) METHOD FOR CONTROLLING CLEANING COOKING APPLIANCE

(71) Applicant: LG Electronics Inc., Seoul (KR)

(72) Inventors: Seungtae Jang, Seoul (KR); Moon Ho Choi, Seoul (KR); Junhee Lee, Seoul (KR); Jaekeun Lee, Busan (KR); Younghwan Kwon, Changwon-si (KR); Seungho Han, Busan (KR); Byeongmin Kim, Busan (KR)

(73) Assignee: LG ELECTRONICS INC., Seoul (KR)

( * ) Notice: Subject to any disclaimer, the term of this patent is extended or adjusted under 35 U.S.C. 154(b) by 21 days.

(21) Appl. No.: 18/767,108

(22) Filed: Jul. 9, 2024

(65) Prior Publication Data

US 2025/0060107 A1 Feb. 20, 2025

(30) Foreign Application Priority Data

Aug. 16, 2023 (KR) ..... 10-2023-0106761

(51) Int. Cl.
*F24C 14/02* (2006.01)
*F24C 7/08* (2006.01)
*F24C 15/32* (2006.01)

(52) U.S. Cl.
CPC ..... *F24C 14/02* (2013.01); *F24C 7/085* (2013.01); *F24C 15/322* (2013.01)

(58) Field of Classification Search
CPC ..... F24C 14/02; F24C 7/085; F24C 15/322; F24C 7/087; F24C 7/067; F24C 15/2014
See application file for complete search history.

(56) References Cited

U.S. PATENT DOCUMENTS 5,534,678 A * 7/1996 Bowles ..... F24C 14/02 219/398
6,730,879 B1 * 5/2004 Muegge ..... F24C 14/02 219/486

(Continued)

FOREIGN PATENT DOCUMENTS

CA 2140602 A1 7/1996
EP 1251317 A2 * 10/2002 ..... F24C 7/087

(Continued)

OTHER PUBLICATIONS

KR 2021-0106291 (Year: 2021).*
KR 2005-0081372 (Year: 2005).*

*Primary Examiner* — Alexander Markoff
(74) *Attorney, Agent, or Firm* — Birch, Stewart, Kolasch & Birch, LLP

(57) ABSTRACT

A method for controlling cleaning of a cooking appliance is discussed. The cooking appliance may include a cavity configured to accommodate food to be cooked, the cavity including a panel, a broil heater configured to apply radiant heat to the cavity, and a bake heater configured to heat the panel. Additionally, the method may include selecting a mode including selecting a self-clean mode of the cavity, increasing an internal temperature of the cavity to a set second temperature, and maintaining the internal temperature of the cavity at the second temperature. Further, the increasing the internal temperature may include controlling a temperature increase rate inside the cavity in the increasing the internal temperature by operating the broil heater and the bake heater alternately.

17 Claims, 14 Drawing Sheets

(56) References Cited

U.S. PATENT DOCUMENTS

| | | | | |
|---|---|---|---|---|
| 10,865,999 | B2 * | 12/2020 | Neal | F24C 3/128 |
| 2003/0015518 | A1 * | 1/2003 | Baker | F24C 7/087 219/486 |
| 2008/0237212 | A1 * | 10/2008 | Blackson | F24C 7/087 219/398 |
| 2016/0345767 | A1 * | 12/2016 | Cadima | F24C 3/128 |
| 2017/0118798 | A1 * | 4/2017 | Johnson | H05B 1/0263 |
| 2018/0363917 | A1 * | 12/2018 | Lim | F24C 14/02 |
| 2020/0278120 | A1 | 9/2020 | Neal | |
| 2022/0000124 | A1 * | 1/2022 | Kang | A21B 1/36 |
| 2022/0330556 | A1 * | 10/2022 | Swayne | F24C 1/04 |
| 2023/0213203 | A1 * | 7/2023 | Conde Zelocuatecatl | F24C 15/325 126/1 R |
| 2024/0369230 | A1 * | 11/2024 | Guyett | H05B 1/0263 |
| 2024/0397591 | A1 * | 11/2024 | Chae | H05B 6/686 |
| 2025/0060107 | A1 * | 2/2025 | Jang | F24C 15/322 |
| 2025/0102149 | A1 * | 3/2025 | Lee | F24C 7/087 |

FOREIGN PATENT DOCUMENTS

| | | | |
|---|---|---|---|
| EP | 2 354 666 | A2 | 8/2011 |
| KR | 10-2005-0081372 | A | 8/2005 |

* cited by examiner

METHOD FOR CONTROLLING CLEANING COOKING APPLIANCE

CROSS-REFERENCE TO RELATED APPLICATION

This application claims priority to and benefit of Korean Patent Application No. 10-2023-0106761, filed on Aug. 16, 2023, which is hereby incorporated by reference as if fully set forth herein.

BACKGROUND

Field

The present disclosure relates to a method for controlling cleaning of a cooking appliance, and more particularly, to a method for controlling cleaning of a cooking appliance that is used in a removal process of organic matter in a thermal decomposition scheme.

Description of Related Art

The content described in this section simply provides background information on the present disclosure and does not constitute prior art.

A user may have numerous home appliances in their home. One of the home appliances may be a cooking appliance. A cooking appliance has a cavity that accommodates food to be cooked therein. The cavity is defined as a space by panels.

The cooking appliance is equipped with the cavity and a heating device to heat the food. There may be a plurality of heating devices, and each heating device may heat air and the food in the cavity via conduction, convection, or radiation.

Additionally, during a cooking process, the cavity and the food is heated at a high temperature, so that organic matter contained in the food may splash or spill into the cavity. In the high-temperature environment, the organic matter from the food may be attached to a surface of the panel constituting the cavity.

For hygiene aesthetics, and for maintaining a function of the cooking appliance, it is necessary to remove the organic matter attached to the surface of the panel. The cooking appliance may have a self-clean function to remove such organic matter on its own.

The self-clean is a separate function that is distinct from a cooking function of the cooking appliance. The cooking appliance may operate a self-clean mode when not performing the cooking to remove the organic matter attached to the panel.

The self-clean mode involves operating the heating device equipped in the cooking appliance to heat the cavity at the high temperature to thermally decompose and remove the organic matter attached to the surface of the panel. The organic matter may react with oxygen in air at the high temperature and be oxidized, and thus be separated and removed from the panel.

During the thermal decomposition process, the lower the oxidation temperature at which the organic matter reacts with oxygen in air, the easier the thermal decomposition of the organic matter may occur. Additionally, as a thermal decomposition amount of the organic matter increases during the thermal decomposition process, the organic matter may be effectively removed.

Therefore, it is necessary to identify what factors may decrease the oxidation temperature and increase the thermal decomposition amount of the organic matter in the self-clean mode.

There is a need to identify such factors and develop a method for controlling cleaning of the cooking appliance that may increase the removal effect of the organic matter based on such factors.

SUMMARY OF THE DISCLOSURE

The present disclosure is to provide a method for controlling cleaning of a cooking appliance that has a structure that may easily remove organic matter attached to a panel including a cavity.

Additionally, the present disclosure may provide a method for controlling cleaning of a cooking appliance that has a structure that may lower an oxidation temperature of organic matter and increase a thermal decomposition amount in a self-clean mode.

Additionally, the present disclosure may provide a method for controlling cleaning of a cooking appliance that controls a temperature increase rate of a cavity to lower an oxidation temperature of organic matter and increase a thermal decomposition amount in a self-clean mode.

However, the advantages according to the present disclosure are not limited to the above-mentioned purposes. Other purposes and advantages according to the present disclosure that are not mentioned may be understood based on following descriptions, and may be more clearly understood based on embodiments according to the present disclosure. Further, it will be easily understood that the purposes and advantages according to the present disclosure may be realized using means shown in the claims or combinations thereof.

An embodiment of the present disclosure may include a method for controlling cleaning of a cooking appliance may include selecting a mode including selecting a self-clean mode of a cavity, increasing a temperature by increasing an internal temperature of the cavity to a set second temperature, and maintaining a temperature by maintaining the internal temperature of the cavity at the second temperature. The increasing the temperature may further include controlling a temperature increase rate inside the cavity in the increasing the temperature by operating a broil heater and a bake heater alternately.

Further, an oxidation temperature of organic matter may be lowered, and a thermal decomposition amount of the organic matter may be increased by controlling the temperature increase rate inside the cavity.

The increasing the temperature may include increasing the internal temperature of the cavity to a first temperature, and increasing the internal temperature of the cavity to reach the second temperature from the first temperature. A temperature increase rate inside the cavity in the increasing the internal temperature of the cavity to a first temperature may be set higher than a temperature increase rate inside the cavity in the increasing the internal temperature of the cavity to reach the second temperature. Accordingly, a removal effect of the organic matter may be improved by increasing a time during which an oxidation reaction of the organic matter occurs.

In the increasing the temperature, the outer heater may operate continuously, the inner heater and the bake heater may operate in a continuous manner and operate alternately with each other, and an operation time of the bake heater may be set larger than an operation time of the inner heater.

Accordingly, the temperature increase rate of the cavity may be maintained approximately uniformly in the increasing the temperature.

In the increasing the temperature, the outer heater may not operate, and the inner heater and the bake heater may operate in a continuous manner and operate alternately with each other to increase the temperature of the cavity. Accordingly, power consumption resulted from the heater operation in the increasing the temperature may be reduced.

A cooking appliance according to an embodiment of the present disclosure may include a cavity where food to be cooked is accommodated, a broil heater that applies radiant heat to the cavity, and a bake heater that heats a panel including the cavity.

A method for controlling cleaning of a cooking appliance according to an embodiment of the present disclosure may include selecting a mode including selecting a self-clean mode of a cavity, increasing a temperature by increasing an internal temperature of the cavity to a set second temperature, and maintaining a temperature by maintaining the internal temperature of the cavity at the second temperature. The increasing the temperature may include controlling a temperature increase rate inside the cavity in the temperature increasing step by operating a broil heater and a bake heater alternately.

The broil heater may include an inner heater disposed at an upper portion of the cavity, and an outer heater disposed at the upper portion of the cavity and configured to surround the inner heater, wherein the outer heater has an output lower than an output of the inner heater.

The increasing the temperature may include alternately operating the inner heater and the bake heater to control the temperature increase rate inside the cavity.

The increasing the temperature may include a increasing the internal temperature of the cavity to a first temperature set lower than the second temperature, and increasing the internal temperature of the cavity to reach the second temperature from the first temperature.

A temperature increase rate inside the cavity in the increasing the internal temperature of the cavity to a first temperature may be set higher than a temperature increase rate inside the cavity in the increasing the internal temperature of the cavity to reach the second temperature.

In the increasing the internal temperature of the cavity to a first temperature, the outer heater may operate continuously, and the inner heater and the bake heater may operate in a continuous manner and operate alternately with each other. In the increasing the internal temperature of the cavity to reach the second temperature, the outer heater may operate continuously, and the inner heater and the bake heater may operate alternately with each other, but there may be a time period where both the inner heater and the bake heater do not operate.

In the maintaining the temperature, the outer heater may operate continuously, and the inner heater and the bake heater may operate in a continuous manner and operate alternately with each other.

In the increasing the internal temperature of the cavity to a first temperature, the outer heater may not operate, and the inner heater and the bake heater may operate in a continuous manner and operate alternately with each other. In the increasing the internal temperature of the cavity to reach the second temperature, the outer heater may not operate, and the inner heater and the bake heater may operate alternately with each other, but there may be a time period where both the inner heater and the bake heater do not operate.

In the maintaining the temperature, the outer heater may not operate, and the inner heater and the bake heater may operate in a continuous manner and operate alternately with each other.

In the increasing the temperature, the outer heater may operate continuously, the inner heater and the bake heater may operate in a continuous manner and operate alternately with each other, and an operation time of the bake heater may be set larger than an operation time of the inner heater.

In the maintaining the temperature, the outer heater may operate continuously, the inner heater and the bake heater may operate in a continuous manner and operate alternately with each other, and an operation time of the bake heater may be set larger than an operation time of the inner heater.

In the increasing the temperature, the outer heater may not operate, the inner heater and the bake heater may operate in a continuous manner and operate alternately with each other, and an operation time of the bake heater may be set larger than an operation time of the inner heater.

In the maintaining the temperature, the outer heater may not operate, the inner heater and the bake heater may operate in a continuous manner and operate alternately with each other, and an operation time of the bake heater may be set larger than an operation time of the inner heater.

A cooking appliance according to another embodiment may include a cavity where food to be cooked is accommodated, an inner heater disposed at an upper portion of the cavity, and an outer heater disposed at the upper portion of the cavity to surround the inner heater, wherein the outer heater has an output lower than an output of the inner heater. The cooking appliance includes a bake heater that heats a panel including the cavity.

A method for controlling cleaning of a cooking appliance according to another embodiment may include increasing a temperature by increasing an internal temperature of a cavity to a set second temperature, and maintaining a temperature by maintaining the internal temperature of the cavity at the second temperature. The increasing the temperature may include increasing the internal temperature of the cavity to a first temperature set lower than the second temperature, and increasing the internal temperature of the cavity to reach the second temperature from the first temperature. A temperature increase rate inside the cavity in the first step is set higher than a temperature increase rate inside the cavity in the second step.

In the increasing the internal temperature of the cavity to a first temperature, the outer heater may operate continuously, and the inner heater and the bake heater may operate in a continuous manner and operate alternately with each other. In the increasing the internal temperature of the cavity to reach the second temperature, the outer heater may operate continuously, and the inner heater and the bake heater may operate alternately with each other, but there may be a time period where both the inner heater and the bake heater do not operate. In the maintaining the temperature, the outer heater may operate continuously, and the inner heater and the bake heater may operate in a continuous manner and operate alternately with each other.

A method for controlling cleaning of a cooking appliance according to another embodiment may include a cavity where food to be cooked is accommodated, a heater that heats the interior of the cavity, and a controller that controls the heater. The method may include increasing a temperature by increasing an internal temperature of the cavity to a set second temperature, and maintaining a temperature by maintaining the internal temperature of the cavity at the second temperature.

The increasing the temperature may include increasing the internal temperature of the cavity to a first temperature set lower than the second temperature, and increasing the internal temperature of the cavity to reach the second temperature from the first temperature. A temperature increase rate inside the cavity in the increasing the internal temperature of the cavity to a first temperature may be set higher than a temperature increase rate inside the cavity in the increasing the internal temperature of the cavity to reach the second temperature from the first temperature.

The heater may include a plurality of heaters, and in the increasing the internal temperature of the cavity to reach the second temperature from the first temperature, there may be a time period where some of the plurality of heaters operating in the increasing the internal temperature of the cavity to a first temperature do not operate.

The heater may include an inner heater disposed at an upper portion of the cavity, an outer heater disposed at the upper portion of the cavity to surround the inner heater, wherein the outer heater has an output lower than an output of the inner heater, and a bake heater that heats a panel including the cavity. The increasing the temperature may include controlling the temperature increase rate inside the cavity by operating the inner heater and the bake heater alternately.

In the increasing the internal temperature of the cavity to a first temperature, the outer heater may operate continuously, and the inner heater and the bake heater may operate in a continuous manner and operate alternately with each other. In the increasing the internal temperature of the cavity to reach the second temperature from the first temperature, the outer heater may operate continuously, and the inner heater and the bake heater may operate alternately with each other, but there may be a time period where both the inner heater and the bake heater do not operate.

In the increasing the internal temperature of the cavity to a first temperature, the outer heater may not operate, and the inner heater and the bake heater may operate in a continuous manner and operate alternately with each other. In the increasing the internal temperature of the cavity to reach the second temperature from the first temperature, the outer heater may not operate, and the inner heater and the bake heater may operate alternately with each other, but there may be a time period where both the inner heater and the bake heater do not operate.

In the maintaining the temperature, the outer heater may operate continuously, and the inner heater and the bake heater may operate in a continuous manner and operate alternately with each other.

A method for controlling cleaning of a cooking appliance according to another embodiment of the present disclosure may include increasing a temperature by increasing an internal temperature of a cavity to a set second temperature, and maintaining a temperature by maintaining the internal temperature of the cavity at the second temperature. In the increasing the temperature and the maintaining the temperature, the inner heater and the bake heater operate in a continuous manner and operate alternately with each other, and an operation time of the bake heater is set larger than an operation time of the inner heater.

In the method for controlling the cleaning of the cooking appliance according to an embodiment of the present disclosure, the temperature of the cavity may be increased relatively quickly up to the first temperature that is close to the oxidation temperature of the organic matter, and the temperature increase rate may be reduced when the first temperature is reached.

Accordingly, the removal effect of the organic matter may be increased by increasing the time from the time point at which the oxidation reaction of the organic matter occurs to the time point of reaching the second temperature, and thus increasing the time during which the oxidation reaction of the organic matter occurs.

Further, in the method for controlling the cleaning of the cooking appliance according to the an embodiment of the present disclosure, the oxidation temperature of the organic matter may be effectively lowered and the thermal decomposition amount may be effectively increased by maintaining the temperature increase rate of the cavity approximately uniformly in the increasing the temperature.

Further, in the method for controlling the cleaning of the cooking appliance according to the an embodiment of the present disclosure, the temperature increase rate of the cavity may decrease in the increasing the temperature. Therefore, while proceeding the self-clean mode, the time for which the temperature of the cavity is maintained at the second temperature, which is the maximum temperature, may be reduced.

Therefore, the total heating amount inside the cooking appliance may decrease while proceeding the self-clean mode. As a result, the overheating of the cooking appliance may be suppressed, thereby effectively preventing the fire from occurring in the electrical devices and other combustible components disposed in the cooking appliance.

In addition to the above-mentioned effects, specific effects of the present disclosure will be described below while describing the specific details for carrying out the invention.

BRIEF DESCRIPTION OF THE DRAWINGS

The present disclosure will become more fully understood from the detailed description given hereinbelow and the accompanying drawings which are given by way of illustration only, and thus are not limitative of the present disclosure.

DETAILED DESCRIPTIONS OF THE EMBODIMENTS

Figure 1:
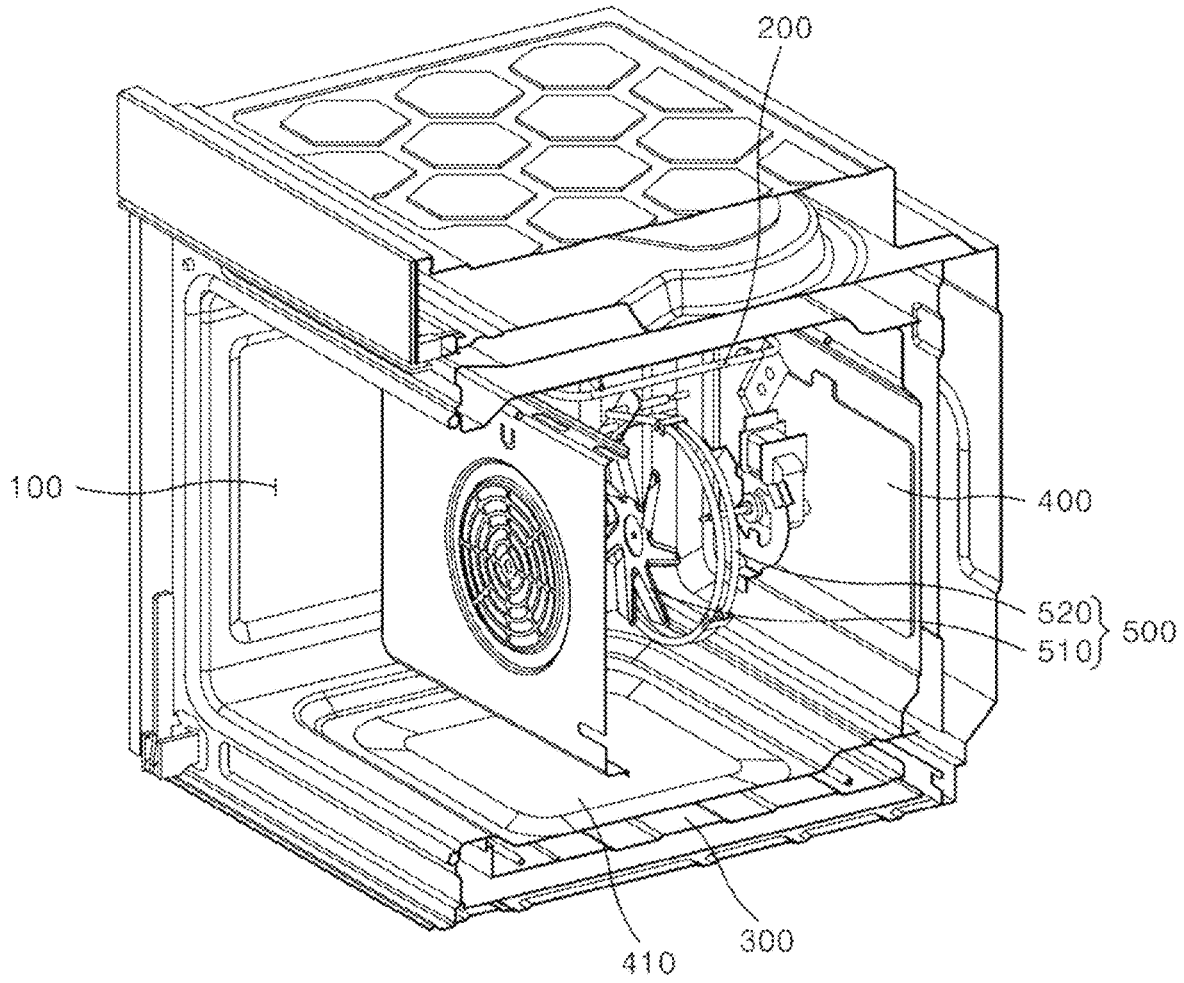
FIG. 1 is a diagram schematically showing a cooking appliance according to an embodiment of the present disclosure.

The above-mentioned purposes, features, and advantages will be described in detail later with reference to the attached drawings, so that those skilled in the art in the technical field to which the present disclosure belongs may easily practice the technical ideas of the present disclosure. In describing the present disclosure, when it is determined that a detailed description of the publicly known technology related to the present disclosure may unnecessarily obscure the gist of the present disclosure, the detailed description thereof will be omitted. Hereinafter, various embodiments according to the present disclosure will be described in detail with reference to the attached drawings. In the drawings, identical reference numerals are used to indicate identical or similar components.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section, and may not define order or sequence. Thus, a first element, component, region, layer or section described under could be termed a second element, component, region, layer or section, without departing from the spirit and scope of the present disclosure.

As used herein, the singular constitutes "a" and "an" are intended to include the plural constitutes as well, unless the context clearly indicates otherwise.

It will be further understood that the terms "comprise", "comprising", "include", and "including" when used in this specification, specify the presence of the stated features, integers, operations, elements, and/or components, but do not preclude the presence or addition of one or more other features, integers, operations, elements, components, and/or portions thereof.

Throughout the present disclosure, "A and/or B" means A, B, or A and B, unless otherwise specified, and "C to D" means C inclusive to D inclusive unless otherwise specified.

Throughout the present document, "up, down, front, rear" refers to a location of a cooking appliance when the cooking appliance is installed for daily use. Additionally, throughout the present document, a "vertical direction" refers to a vertical direction of the cooking appliance when the cooking appliance is installed for daily use. A "left and right direction" refers to a direction perpendicular to the vertical direction, and a front and rear direction refers to a direction perpendicular to both the vertical direction and the left and right direction. A "lateral direction" may have the same meaning as the left and right direction, and these terms may be used interchangeably herein. Further, the term "may" encompasses all the meanings of the term "can." Also all the components of each appliance or apparatus according to all embodiments of the present disclosure are operatively coupled and configured.

FIG. 1 is a diagram schematically showing a cooking appliance according to an embodiment of the present disclosure.

Referring to FIG. 1, the cooking appliance may include a cavity 100, which is a space in which food to be cooked is accommodated. The food to be cooked may be placed in the cavity 100 and may be heated at a high temperature.

Further, the cooking appliance may have a panel 400 to define the cavity 100. The panel 400 may be open at a front side facing a door and may include side plates, a bottom plate 410, and a ceiling plate 420. The side plate may form a side wall of the cavity 100, the bottom plate 410 may form a bottom of the cavity 100, and the ceiling plate 420 may form a ceiling of the cavity 100.

In addition, the food placed in the cavity 100 may be heated in a high-temperature environment. To this end, the cooking appliance may be equipped with a heater to heat the cavity 100.

When the food is heated, some of organic matter contained in the food may become attached to an inner wall of the panel 400, which constitutes the cavity 100. When the organic matter attached to the panel 400 is left as is, hygiene problems will arise. Accordingly, the organic matter needs to be removed periodically to reduce hygiene problems.

To remove the organic matter attached to the panel 400, the cavity 100 may be heated using the heater disposed in the cooking appliance, so that the organic matter may be removed via thermal decomposition. A reaction formula for the thermal decomposition is as follows.

$$\text{organic matter} + O_2 + \text{heat} \rightarrow CO + H_2 + CmHn + \text{ash}$$

In other words, when heat is applied to the organic matter, the organic matter may react with oxygen in air and be oxidized, so that carbon monoxide, hydrogen, hydrocarbon, and ash may be generated as products of the oxidation of the organic matter. Carbon monoxide and hydrogen go into air, and hydrocarbon and ash fall from a surface of the panel 400, so that the organic matter attached to the panel 400 may be removed.

To apply heat to the organic matter attached to the panel 400, the cavity 100 may be heated at the high temperature, for example, at a temperature equal to or higher than approximately 400° C. The heating of the cavity 100 may be carried out by the heater disposed in the cooking appliance.

Such organic matter removal process using the thermal decomposition scheme may be carried out separately from a cooking process of the cooking appliance. A method for controlling cleaning of a cooking appliance according to an embodiment of the present disclosure relates to a method for controlling cleaning of a cooking appliance used in the removal process of the organic matter using the thermal decomposition scheme.

Hereinafter, the heater disposed in the cooking appliance according to examples of the present disclosure will be described.

Figure 2:
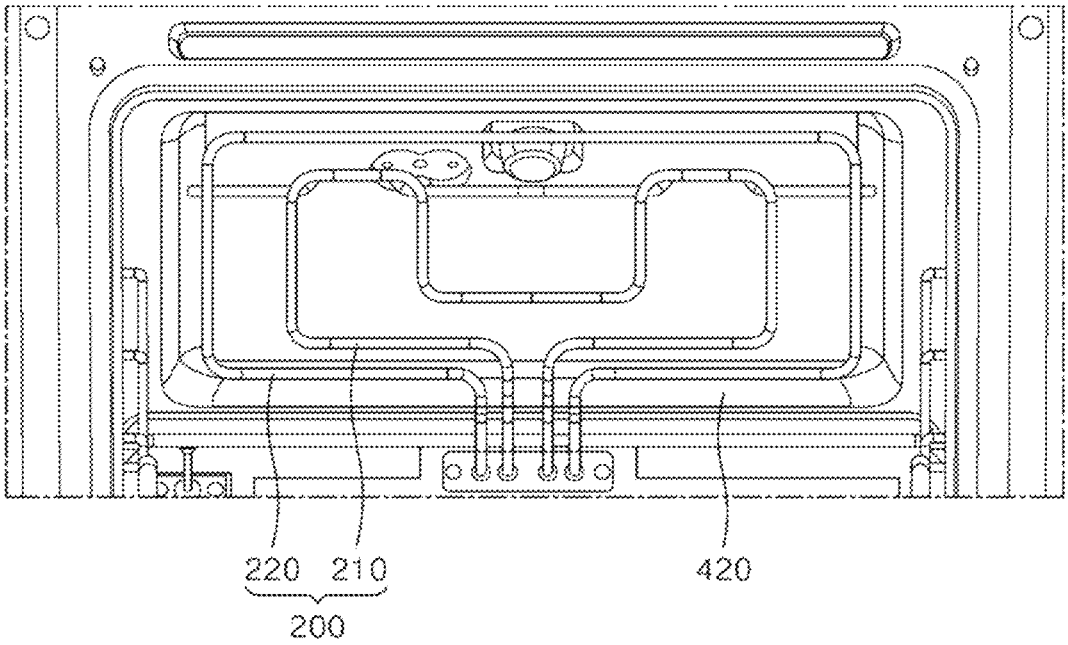
FIG. 2 is a view of a ceiling plate from inside a cavity of a cooking appliance according to an embodiment of the present disclosure.
Figure 3:
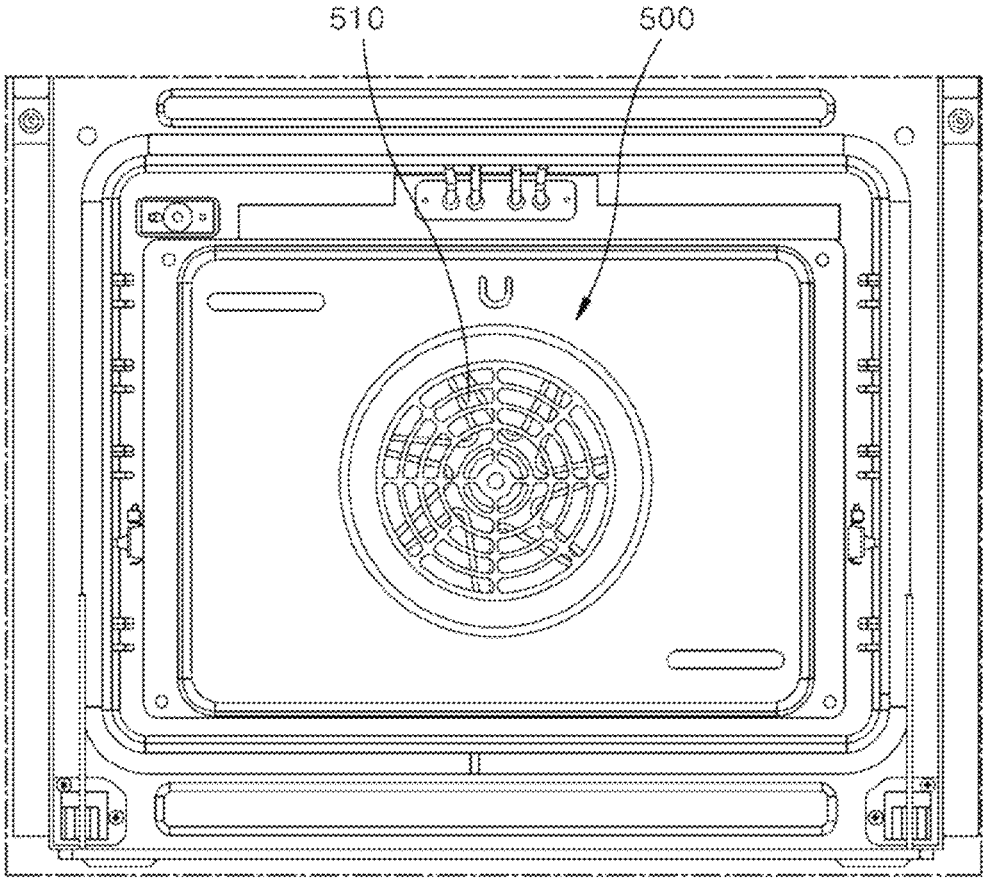
FIG. 3 is a rear view from inside a cavity of a cooking appliance according to an embodiment of the present disclosure.
Figure 4:
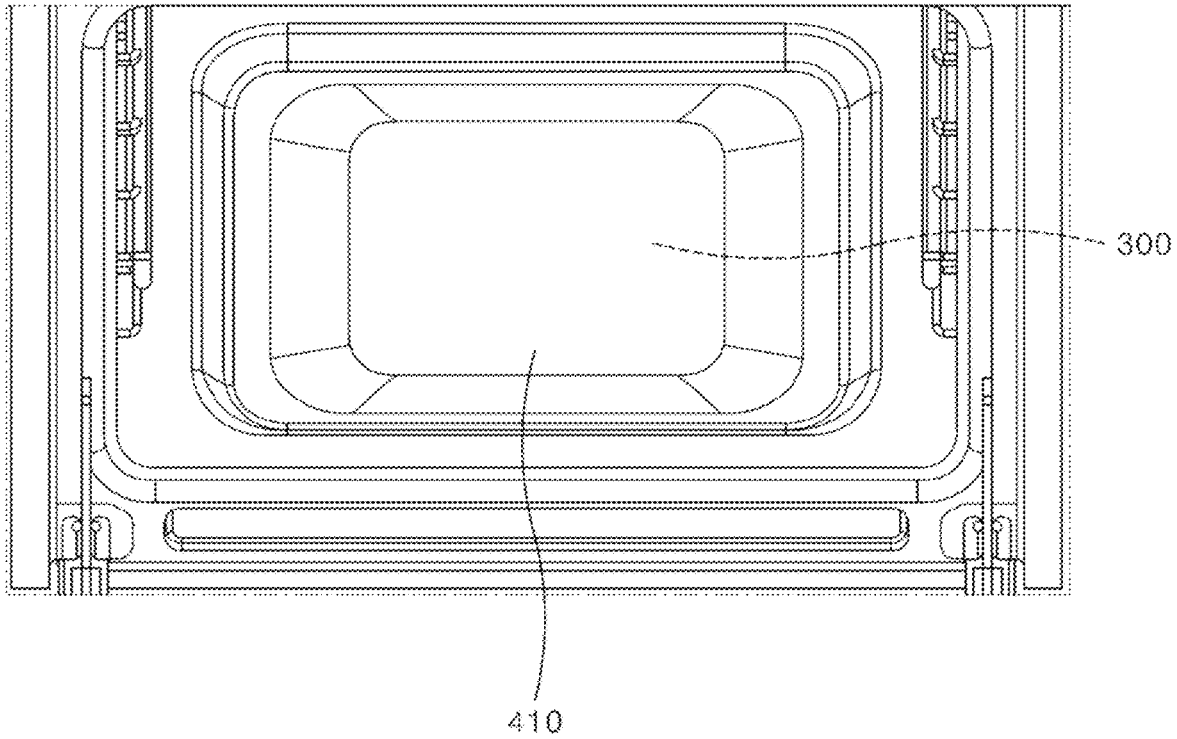
FIG. 4 is a view of a bottom plate from inside a cavity of a cooking appliance according to an embodiment of the present disclosure.

Particularly, FIG. 2 is a view of the ceiling plate 420 from inside of the cavity 100 of the cooking appliance according to an embodiment of the present disclosure. FIG. 3 is a rear view from inside of the cavity 100 of the cooking appliance according to an embodiment of the present disclosure. FIG. 4 is a view of the bottom plate 410 from inside of the cavity 100 of the cooking appliance according to an embodiment of the present disclosure.

Referring to FIGS. 1 to 4, the cooking appliance may include a broil heater 200, a bake heater 300, and a convection heater 500. Such heaters may be operated via, for example, an electric resistance heating scheme.

The broil heater 200 may apply radiant heat to the cavity 100. For example, the broil heater 200 may be disposed at an upper portion of the cavity 100. For example, the broil heater 200 may be disposed at a location adjacent to the ceiling plate 420 of the panel 400, and may be equipped as a heating tube and configured to heat air in the cavity 100 by applying the radiant heat to the cavity 100.

The bake heater 300 may heat the panel 400 including the cavity 100. For example, the bake heater 300 may be disposed under the bottom plate 410 of the panel 400 and disposed outside the cavity 100. The bake heater 300 may be equipped as a plate-shaped heating element or a heating tube and configured to apply the radiant heat to the bottom plate 410.

The heat from the bottom plate 410 heated by the bake heater 300 may be transferred to an entirety of the panel 400 via conduction. The panel 400 heated as such may apply the radiant heat to the cavity 100. Therefore, the bake heater 300 may heat air in the cavity 100 by transferring the heat sequentially via radiation, conduction, and radiation.

The convection heater 500 may be disposed at a rear portion of the cavity 100 to extend through the panel 400, and may include a fan 510 and a convection heating unit 520. The convection heating unit 520 may be equipped as a heating tube. The fan 510 may be disposed in front of the convection heating unit 520 and operate to circulate air inside the cavity 100. Accordingly, the heat of the convection heating unit 520 may heat air in the cavity 100 via convection.

In the typical food cooking process, the convection heater 500 disposed in the cooking appliance may operate to cook the food. However, in the method for controlling the cleaning of the cooking appliance used in the organic matter removal process according to the embodiment, the convection heating unit 520 of the convection heater 500 may not operate.

In the method for controlling the cleaning of the cooking appliance according to the embodiment, when the cavity 100 is heated using all of the three types of heaters, a temperature increase rate inside the cavity 100 is excessively high. Accordingly, to better control the temperature increase rate inside the cavity 100, only the broil heater 200 and the bake heater 300 may be used. Therefore, the convection heating unit 520, which is not suitable for controlling the temperature increase rate inside the cavity 100 in the embodiment, may not be used in the self-clean mode.

However, to effectively remove the organic matter, it is necessary to distribute the heat evenly inside the cavity 100. Accordingly, the fan 510 may be operated during the organic matter removal process. In conclusion, in the method for controlling the cleaning of the cooking appliance for removing the organic matter according to the embodiment, the fan 510, the broil heater 200, and the bake heater 300 may operate.

To effectively remove the organic matter attached to the panel 400, the lower the oxidation temperature TC, which is a temperature at which the organic matter reacts with oxygen in air and is oxidized, the more advantageous it is. This is because, as the oxidation temperature TC becomes lower, less power is consumed, and when a total time required for the organic matter removal process is the same, an oxidation time of the organic matter becomes larger compared to that in a case in which the oxidation temperature TC is high.

Therefore, it is necessary to find factors that may lower the oxidation temperature TC. In an embodiment of the present disclosure, an experiment was conducted to elucidate a relationship between the temperature increase rate of the cavity 100 and the oxidation temperature TC during the organic matter removal process.

Additionally, in the embodiment, when the temperature of the cavity 100 is increased to reach a set second temperature T2, the organic matter removal process may be performed in a scheme of maintaining the temperature of the cavity 100 at the second temperature T2.

Therefore, in the experiment, a relationship between a thermal decomposition amount of the organic matter, that is, an amount of the organic matter oxidized by heat, and the temperature increase rate from a time point of the oxidation temperature TC to a time point of reaching the second temperature T2, which is higher than the oxidation temperature, was elucidated together. The greater the thermal decomposition amount of the organic matter, the more effective the organic matter removal is.

An experimental material used in such experiment is deasphalted oil (DAO), which has a similar composition to the organic matter attached to the inner wall of the panel 400 of the cooking appliance. In the experiment, while heating the DAO, the temperature increase rate was adjusted and a trend thereof was observed.

Figure 5:
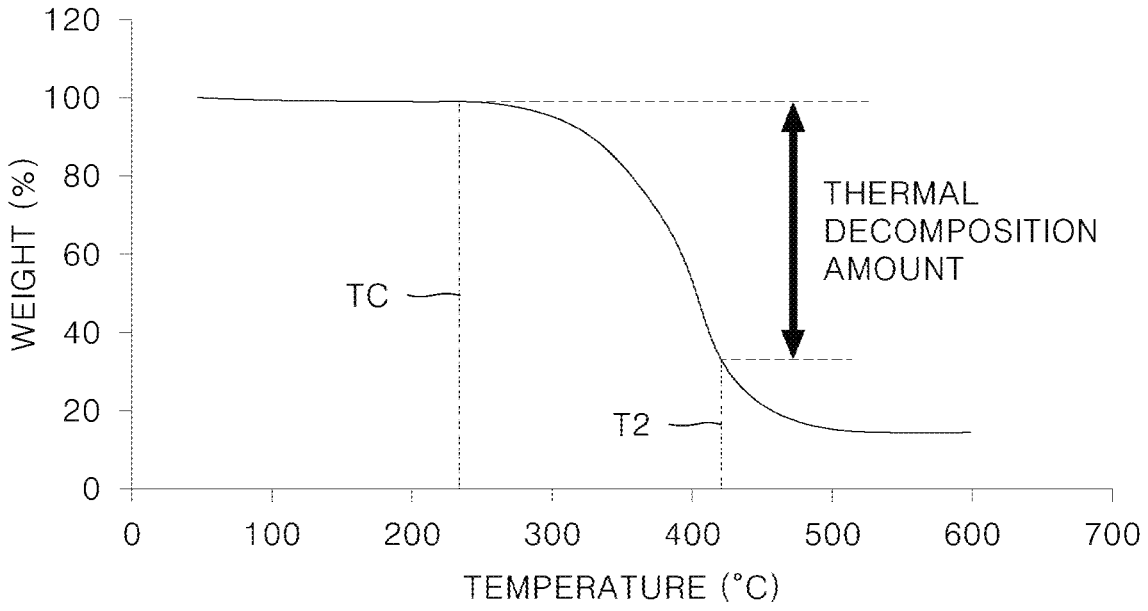
FIG. 5 is a graph to illustrate a temperature increase rate and a thermal decomposition amount of an experimental material.
Figure 6:
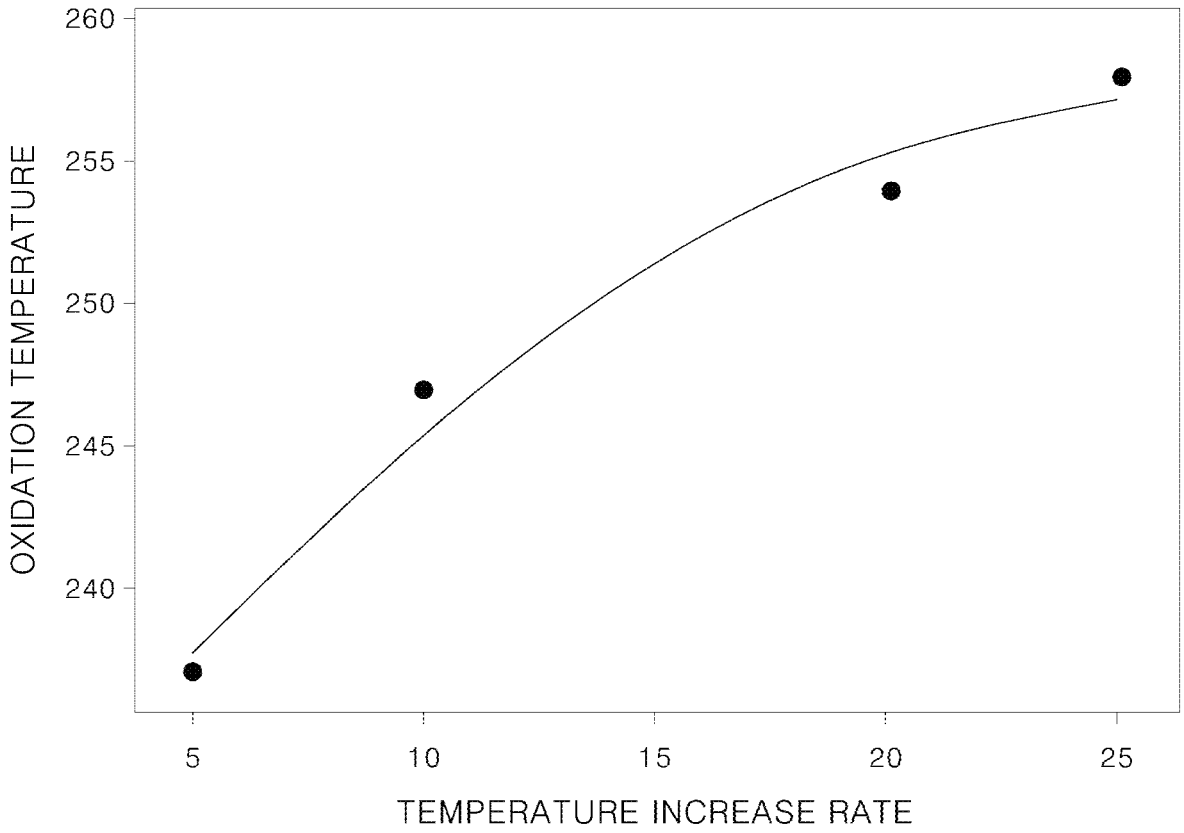
FIG. 6 is a graph showing a temperature increase rate and an oxidation temperature TC of an experimental material.

Hereinafter, experimental results will be described with reference to FIGS. 5 and 6. FIG. 5 is a graph to illustrate a temperature increase rate and a thermal decomposition amount of an experimental material. FIG. 6 is a graph showing a temperature increase rate and an oxidation temperature TC of an experimental material.

Referring to FIG. 5, a vertical axis of the graph represents a weight of the experimental material in percent, and a horizontal axis represents a temperature of the experimental material. Therefore, the thermal decomposition amount of the experimental material means a weight reduction amount of the experimental material from the time point of the oxidation temperature TC to the time point of reaching the second temperature T2, and is shown as a double arrow in FIG. 5.

In the experiment, the second temperature T2 was set at approximately 430° C., which is a temperature set in the general organic matter removal process including the present embodiment.

As the experimental results, relationships between the temperature increase rate, the thermal decomposition amount, and the oxidation temperature TC are as shown in Table 1.

TABLE 1

| Temperature increase rate (° C./min) | Thermal decomposition amount (%) | Oxidation temperature TC (° C.) |
|---|---|---|
| 5 | 69 | 237 |
| 10 | 58 | 247 |
| 20 | 50 | 254 |
| 25 | 43 | 258 |

In FIG. 6, the relationship between the temperature increase rate and the oxidation temperature TC according to the experimental results is shown in the graph.

Regarding the results of the experiment, it may be shown that the lower the temperature increase rate, the lower the oxidation temperature TC. This is determined to be because the lower the temperature increase rate, the smaller the activation energy required for the oxidation reaction, allowing the oxidation reaction of the organic matter to occur even at a relatively low temperature.

Additionally, regarding the results of the experiment, it may be shown that the lower the temperature increase rate, the greater the thermal decomposition amount of the organic matter in the period between the oxidation temperature TC and the second temperature T2. This is determined to be because the lower the temperature increase rate, the smaller the activation energy required for the oxidation reaction, which may accelerate an oxidation reaction rate.

Additionally, regarding the results of the experiment, it may be shown that the lower the temperature increase rate of the cavity 100, the lower the oxidation temperature TC of the organic matter and the greater the thermal decomposition amount before reaching the second temperature T2, which is advantageous in removing the organic matter.

However, when the temperature increase rate is excessively low, it may take a long time to reach the second temperature T2, and the total time required for the organic matter removal process may be large. When such total time is kept the same, a time for which the cavity 100 is maintained at the second temperature T2 may decrease, deteriorating the organic matter removal effect.

Therefore, to increase the organic matter removal effect, it is necessary to appropriately adjust the temperature increase rate. The embodiment presents a method for controlling cleaning of a cooking appliance that controls the temperature increase rate inside the cavity 100 to increase the organic matter removal effect.

The embodiment is the method for controlling the cleaning of the cooking appliance for the process of removing the organic matter attached to the panel 400, which is carried out separately from the cooking process. Specifically, the cleaning of the cooking appliance is carried out in self-clean mode. The specific control to be described below may be performed by a controller disposed in the cooking appliance and controlling the operation of each heater.

Figure 7:
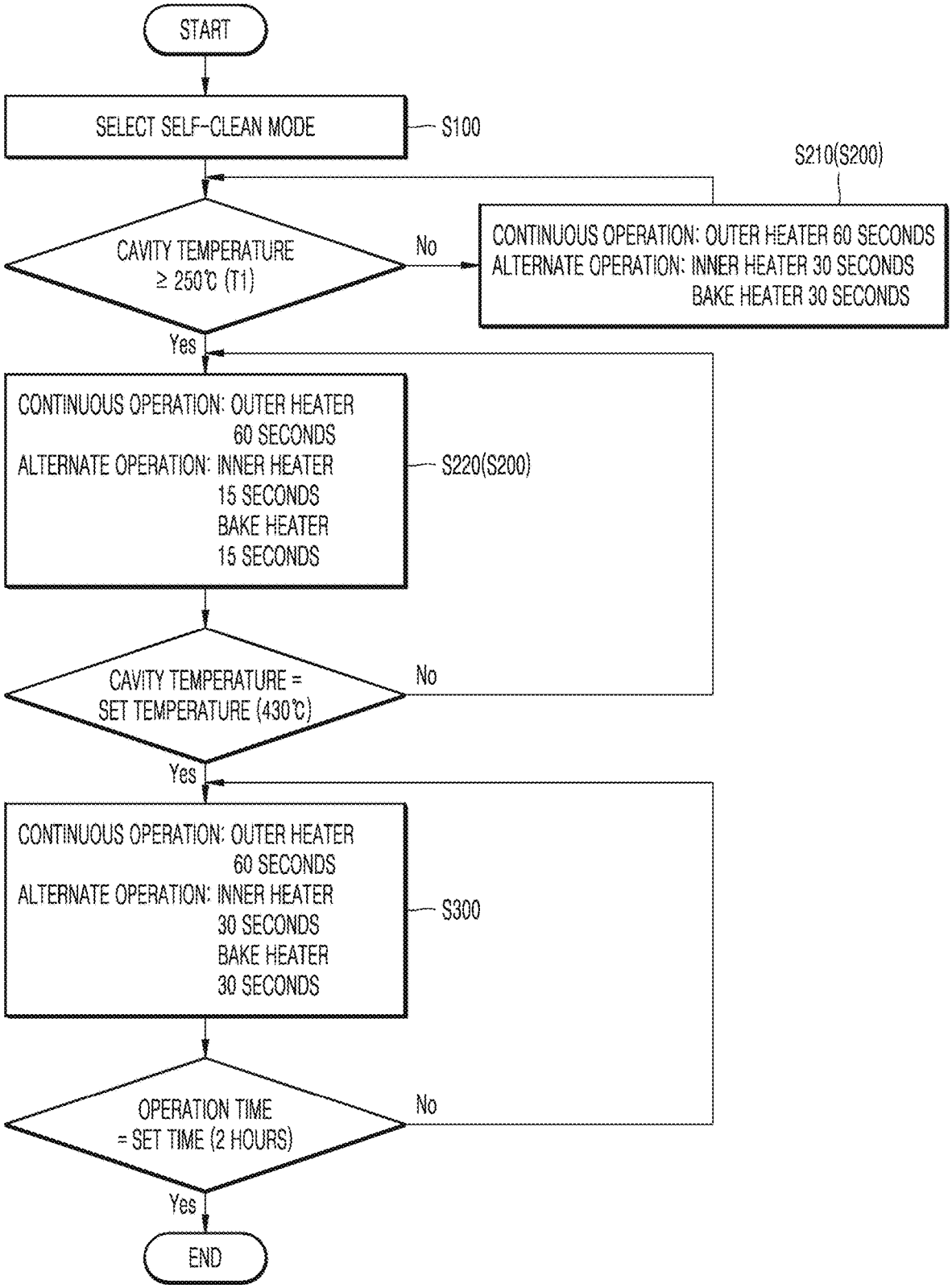
FIG. 7 is a flowchart showing a method for controlling cleaning of a cooking appliance according to Present Example 1.

Referring to FIG. 7, the method for controlling the cleaning of the cooking appliance according to the embodiment may include selecting a mode (S100), increasing a temperature (S200), and maintaining a temperature (S300). In the selecting the mode (S100), the self-clean mode of the cavity 100 may be selected.

The self-clean mode is a function of the cooking appliance that removes the organic matter attached to the panel 400. Additionally, the self-clean mode may be selected by receiving, by a controller, a user's command. In another embodiment, the selection of the self-clean mode may be performed periodically by the controller itself at set date and time without the user's command.

When the self-clean mode is in progress, the controller may sequentially proceed with the increasing the temperature (S200) and the maintaining the temperature (S300). In the increasing the temperature (S200), the internal temperature of the cavity 100 may be increased to the set second temperature T2. The second temperature T2 may be set to, for example, approximately 430° C., but the present disclosure may not be limited thereto.

In the maintaining the temperature (S300), the internal temperature of the cavity 100 may be maintained at the second temperature T2. The self-clean mode may end after a time set in the maintaining the temperature (S300) elapses. The set time, as a total time required for the self-clean mode to proceed, may be, for example, approximately 2 hours, but the present disclosure may not be limited thereto.

In the increasing the temperature (S200), operation of the heaters may be controlled to control the temperature increase rate of the cavity 100 at a set value. When all of the heaters are operated simultaneously, the temperature increase rate of the cavity 100 becomes very high and thus is not able to be controlled at a desired rate.

Therefore, in the increasing the temperature (S200), the broil heater 200 and the bake heater 300 may be operated alternately to control the temperature increase rate inside the cavity 100 in the increasing the temperature (S200). In the increasing the temperature (S200), the temperature increase rate of the cavity 100 may be controlled by operating the broil heater 200 and the bake heater 300 alternately to reduce an amount of heat applied to the cavity 100. Thereby ensuring that the temperature increases at the desired rate.

As shown in FIG. 2, the broil heater 200 may include an inner heater 210 and an outer heater 220. The inner heater 210 may be disposed at the upper portion of the cavity 100.

The outer heater 220 may be disposed at the upper portion of the cavity 100 and configured to surround the inner heater 210. Additionally, the outer heater 220 may have a lower output than the inner heater 210. The outer heater 220 may be disposed in a wider range in the cavity 100 than the inner heater 210.

Therefore, the outer heater 220 may apply the radiant heat to a wider area of the cavity 100 compared to the inner heater 210, so that the outer heater 220 may produce the same temperature increase effect in the cavity 100 as the inner heater 210 with an output smaller than that of the inner heater 210.

For example, for the same temperature increase of the cavity 100, when the inner heater 210 requires an output of approximately 1600 W, the outer heater 220 requires an output of approximately 1500 W. Therefore, it may be appropriate in terms of energy efficiency to use the more efficient outer heater 220 continuously and use the less efficient inner heater 210 non-continuously to perform the self-clean mode.

Therefore, in the increasing the temperature (S200), the temperature increase rate inside the cavity 100 may be controlled by operating the inner heater 210 and the bake heater 300 alternately. Likewise, also in the maintaining the temperature (S300), the temperature inside the cavity 100 may be maintained at the second temperature T2 by operating the inner heater 210 and the bake heater 300 alternately.

However, depending on the embodiment, power consumption required to operate the heaters may be reduced by operating only the inner heater 210 and the bake heater 300 alternately instead of using the outer heater 220 in the increasing the temperature (S200) or in the maintaining the temperature (S300).

Hereinafter, the method for controlling the cleaning of the cooking appliance will be described in detail for each present example. In each present example below, the second temperature T2 may be set to, for example, approximately 430° C., but the present disclosure may not be limited thereto.

Additionally, the set time of the self-clean mode in each present example may be, for example, approximately 2 hours, but the present disclosure may not be limited thereto. The set time may refer to the total time required for the self-clean mode to proceed, and the controller may end the self-clean mode when an operation time of the self-clean mode of the cooking appliance reaches the set time.

Hereinafter, 'for 60 seconds' describes a unit time and does not mean that the total time required for each step is only 60 seconds.

Additionally, the disclosure is not limited to the present examples. The present examples are merely different possible configurations and methods, and the disclosure is not limited thereto.

Present Example 1

FIG. 7 is a flowchart showing a method for controlling cleaning of a cooking appliance according to Present Example 1. In Present Example 1 and Present Example 2, the increasing the temperature (S200) may include increasing the internal temperature of the cavity 100 to a first temperature T1 (S210) and increasing the internal temperature of the cavity 100 to reach the second temperature T2 (S220).

In the increasing the internal temperature of the cavity 100 to a first temperature T1 (S210), the internal temperature of the cavity 100 may be increased to a first temperature T1, which is set to a temperature lower than the second temperature T2. In addition, the first temperature T1 may be the oxidation temperature TC of the organic matter.

However, as described above, the oxidation temperature TC of the organic matter may vary depending on the temperature increase rate of the cavity 100 and may also vary depending on the type of organic matter. Therefore, the first temperature T1 may not be set equal to the oxidation temperature TC of the organic matter.

Therefore, a temperature close to the oxidation temperature TC of the organic matter may be set as the first temperature T1. For example, the first temperature T1 may be set to approximately 250° C., but the present disclosure may not be limited thereto.

In the increasing the internal temperature of the cavity 100 to reach the second temperature T2 (S220), the internal temperature of the cavity 100 may be increased to reach the second temperature T2 from the first temperature T1.

A temperature increase rate inside the cavity 100 in the increasing the internal temperature of the cavity 100 to a first temperature T1 (S210) may be set higher than a temperature increase rate inside the cavity 100 in the increasing the internal temperature of the cavity 100 to reach the second temperature T2 (S220). In the embodiment, the temperature of the cavity 100 may be increased relatively quickly up to the first temperature T1, which may be close to the oxidation temperature TC of the organic matter, and the temperature increase rate may be reduced when the first temperature T1 is reached.

Accordingly, the removal effect of the organic matter may be increased by increasing the time from the time point at which the oxidation reaction of the organic matter occurs to the time point of reaching the second temperature T2, and thus increasing the time during which the oxidation reaction of the organic matter occurs.

To this end, a heat generation amount of the heater in the increasing the internal temperature of the cavity 100 to a first temperature T1 (S210) may be relatively great, and a heat generation amount of the heater in the increasing the internal temperature of the cavity 100 to reach the second temperature T2 (S220) may be relatively small. In the increasing the internal temperature of the cavity 100 to a first temperature T1 (S210), the outer heater 220 may operate continuously, and the inner heater 210 and the bake heater 300 may operate in a continuous manner and operate alternately with each other.

As described above, the cooking appliance may have the plurality of heaters, and in the increasing the internal temperature of the cavity 100 to reach the second temperature T2 (S220), there may be a time period in which some of the plurality of heaters operating in the increasing the internal temperature of the cavity 100 to a first temperature T1 (S210) do not operate.

In the increasing the internal temperature of the cavity 100 to reach the second temperature T2 (S220), the outer heater 220 may operate continuously, and the inner heater 210 and the bake heater 300 may operate alternately, but there may be a time period in which both the inner heater 210 and the bake heater 300 do not operate.

Referring to FIG. 7, for example, in the increasing the internal temperature of the cavity 100 to a first temperature T1 (S210), while the outer heater 220 operates continuously for 60 seconds, the inner heater 210 and the bake heater 300 may operate alternately for 30 seconds each for a total of 60 seconds to increase the temperature of the cavity 100.

In the increasing the internal temperature of the cavity 100 to reach the second temperature T2 (S220), while the outer heater 220 operates continuously for 60 seconds, the inner heater 210 and the bake heater 300 may operate alternately for 15 seconds each for a total of 30 seconds to increase the temperature of the cavity 100. That is, in the increasing the internal temperature of the cavity 100 to reach the second temperature T2 (S220), the inner heater 210 and the bake heater 300 may operate for only 30 seconds out of 60 seconds and may not operate for the remaining 30 seconds.

In such scheme, the temperature increase rate of the cavity 100 may be higher in the increasing the internal temperature of the cavity 100 to a first temperature T1 (S210) and lower in the increasing the internal temperature of the cavity 100 to reach the second temperature T2 (S220).

In the maintaining the temperature (S300), the outer heater 220 may operate continuously, and the inner heater 210 and the bake heater 300 may operate in a continuous manner and operate alternately with each other. For example, in the maintain the temperature (S300), while the outer heater 220 operates continuously for 60 seconds, the inner heater 210 and the bake heater 300 may operate alternately for 30 seconds each for 60 seconds to maintain the temperature of the cavity 100 at the second temperature T2.

In one example, in the maintaining the temperature (S300), when the temperature of the cavity 100 exceeds the second temperature T2, at least one of the bake heater 300, the inner heater 210, and the outer heater 220 may stop operating, thereby maintaining the temperature of the cavity 100 at the second temperature T2.

Present Example 2

Figure 8:
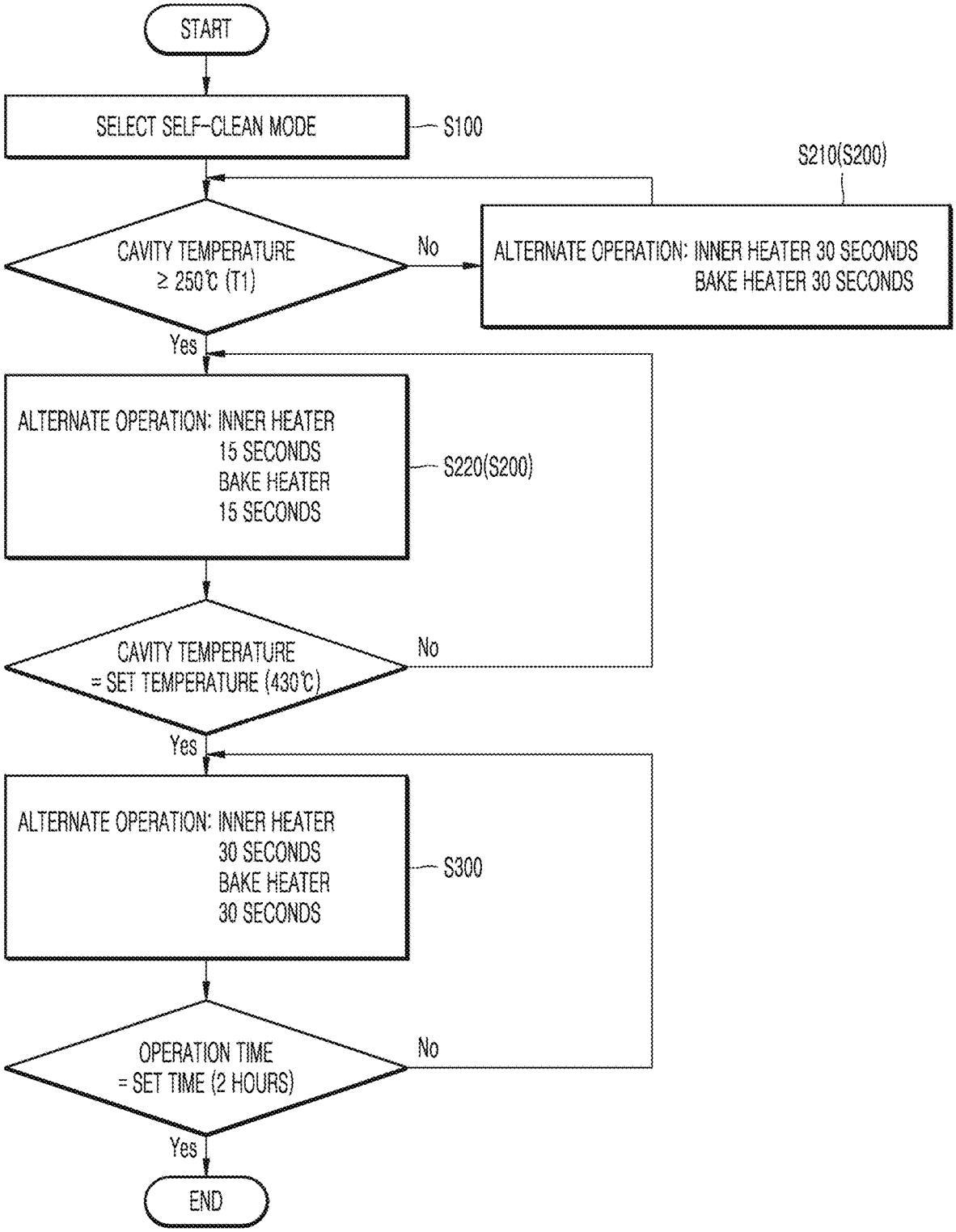
FIG. 8 is a flowchart showing a method for controlling cleaning of a cooking appliance according to Present Example 2.

FIG. 8 is a flowchart showing a method for controlling cleaning of a cooking appliance according to Present Example 2. Compared to Present Example 1, the self-clean mode may proceed in Present Example 2 with the outer heater 220 not operating. Specifically, it is as follows.

Referring to FIG. 8, in the increasing the internal temperature of the cavity 100 to a first temperature T1 (S210), the outer heater 220 may not operate, and the inner heater 210 and the bake heater 300 may operate in a continuous manner and operate alternately with each other. For example, in the increasing the internal temperature of the cavity 100 to a first temperature T1 (S210), the inner heater 210 and the bake heater 300 may operate alternately for 30 seconds each for 60 seconds.

In the increasing the internal temperature of the cavity 100 to reach the second temperature T2 (S220), the outer heater 220 may not operate, and the inner heater 210 and the bake heater 300 may operate alternately, but there may be a time period in which both the inner heater 210 and the bake heater 300 do not operate.

For example, in the increasing the internal temperature of the cavity 100 to reach the second temperature T2 (S220), for 60 seconds, the inner heater 210 and the bake heater 300 may operate alternately for 15 seconds each for a total of 30 seconds to increase the temperature of the cavity 100. That is, in the increasing the internal temperature of the cavity 100 to reach the second temperature T2 (S220), the inner heater 210 and the bake heater 300 may operate for only 30 seconds out of 60 seconds and may not operate for the remaining 30 seconds.

As in Present Example 1, in Present Example 2, the temperature increase rate of the cavity 100 may be higher in the increasing the internal temperature of the cavity 100 to a first temperature T1 (S210) and lower in the increasing the internal temperature of the cavity 100 to reach the second temperature T2 (S220) in such scheme.

In the maintaining the temperature (S300), the outer heater 220 may not operate, and the inner heater 210 and the bake heater 300 may operate in a continuous manner and operate alternately with each other. For example, in the maintaining the temperature (S300), the inner heater 210 and the bake heater 300 may operate alternately for 30 seconds each for 60 seconds to maintain the temperature of the cavity 100 at the second temperature T2.

In one example, when the temperature of the cavity 100 exceeds the second temperature T2 in the maintaining the temperature (S300), at least one of the bake heater 300 and the inner heater 210 may stop operating to maintain the temperature of the cavity 100 at the second temperature T2.

In Present Example 2, the power consumption may be effectively reduced in proceeding the self-clean mode by not using the outer heater 220 in the self-clean mode.

Present Example 3

Figure 9:
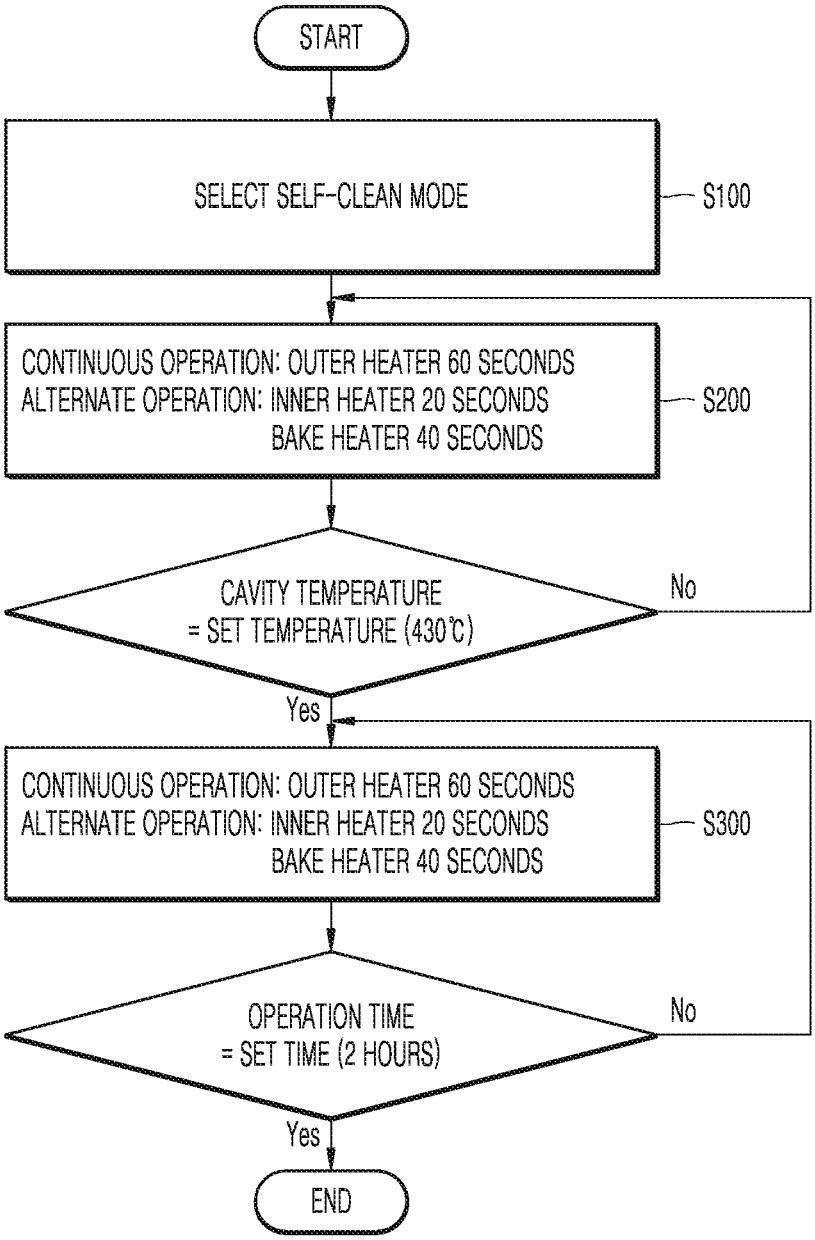
FIG. 9 is a flowchart showing a method for controlling cleaning of a cooking appliance according to Present Example 3.

FIG. 9 is a flowchart showing a method for controlling cleaning of a cooking appliance according to Present Example 3.

Referring to FIG. 9, unlike Present Examples 1 and 2, the increasing the temperature (S200) may not be divided into the increasing the internal temperature of the cavity 100 to a first temperature T1 (S210) and the increasing the internal temperature of the cavity 100 to reach the second temperature T2 (S220) described above in Present Example 3 and in Present Example 4.

In the increasing the temperature (S200), the outer heater 220 may operate continuously, the inner heater 210 and the bake heater 300 may operate in a continuous manner and operate alternately with each other, and an operation time of the bake heater 300 may be set larger than that of the inner heater 210. For example, while the outer heater 220 operates for 60 seconds, the inner heater 210 may operate for 20 seconds and the bake heater 300 may operate for 40 seconds in the alternate manner.

As described above, the inner heater 210 may directly apply the radiant heat to the cavity 100. On the other hand, the bake heater 300 may apply the heat to the cavity 100 via the processes of radiation, conduction, and radiation. Therefore, the bake heater 300 may have a more complicated heat transfer path compared to the inner heater 210, thereby heating the cavity 100 slowly.

Therefore, in Present Example 3, the controller may increase the operation time of the bake heater 300 to be greater than that of the inner heater 210 to reduce the temperature increase rate of the cavity 100, thereby controlling the temperature increase rate of the cavity 100 at the set value in the increasing the temperature (S200).

In the maintaining the temperature (S300), the outer heater 220 may operate continuously, the inner heater 210 and the bake heater 300 may operate in a continuous manner and operate alternately with each other, and the operation time of the bake heater 300 may be set larger than that of the inner heater 210.

The maintaining the temperature (S300) may heat the cavity 100 in the same way as the increasing the temperature (S200). However, in the maintaining the temperature (S300), when the temperature of the cavity 100 exceeds the second temperature T2, at least one of the bake heater 300, the inner heater 210, and the outer heater 220 may stop operating to maintain the temperature of the cavity 100 at the second temperature T2.

Present Example 4

Figure 10:
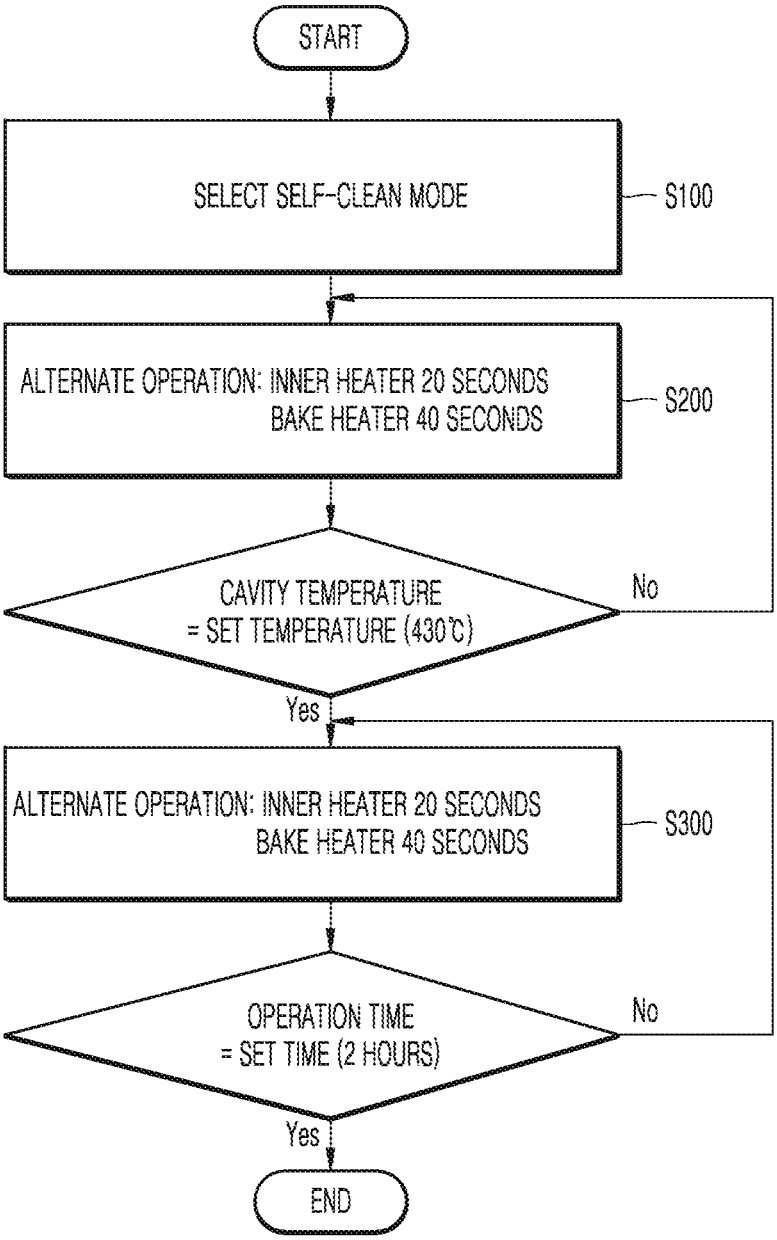
FIG. 10 is a flowchart showing a method for controlling cleaning of a cooking appliance according to Present Example 4.

FIG. 10 is a flowchart showing a method for controlling cleaning of a cooking appliance according to Present Example 4.

Referring to FIG. 10, unlike Present Example 3, Present Example 4 may proceed the self-clean mode with the outer heater 220 not operating.

In the increasing the temperature (S200), the outer heater 220 may not operate, the inner heater 210 and the bake heater 300 may operate in a continuous manner and operate alternately with each other, and the operation time of the bake heater 300 may be set larger than that of the inner heater 210. For example, in the increasing the temperature (S200), for 60 seconds, the inner heater 210 may operate for 20 seconds and the bake heater 300 may operate for 40 seconds alternately to increase the temperature of the cavity 100.

In the maintaining the temperature (S300), the outer heater 220 may not operate, the inner heater 210 and the bake heater 300 may operate in a continuous manner and operate alternately with each other, and the operation time of the bake heater 300 may be set larger than that of the inner heater 210.

The maintaining the temperature (S300) may heat the cavity 100 in the same way as the increasing the temperature (S200). However, when the temperature of the cavity 100 exceeds the second temperature T2 in the maintaining the temperature (S300), at least one of the bake heater 300 and the inner heater 210 may stop operating to maintain the temperature of the cavity 100 at the second temperature T2.

In Present Example 4, the power consumption may be effectively reduced in proceeding the self-clean mode by not using the outer heater 220 in the self-clean mode.

Based on the experimental results, in Present Examples 3 and 4, there is no rapid temperature increase period in the beginning, so that, compared to Present Examples 1 and 2, the oxidation temperature TC of the organic matter may be decreased, and the thermal decomposition amount of the organic matter may be increased in the increasing the temperature (S200).

Therefore, unlike Present Examples 1 and 2, Present Examples 3 and 4 may maintain the temperature increase rate of the cavity 100 approximately uniformly in the increasing the temperature (S200), thereby effectively lowering the oxidation temperature TC of the organic matter and effectively increasing the thermal decomposition amount compared to Present Examples 1 and 2.

Hereinafter, the temperature change of the cavity 100 according to each present example in the self-clean mode will be described with reference to graphs.

Figure 11:
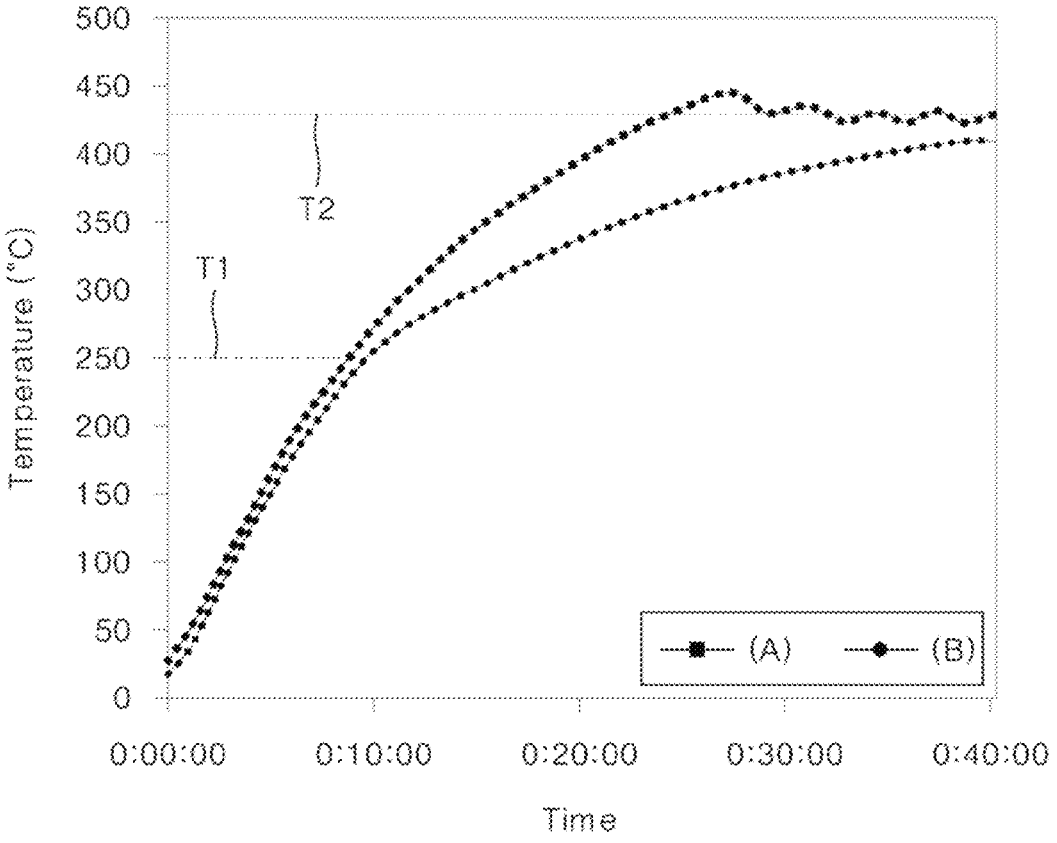
FIG. 11 is a graph to illustrate a temperature change of a cavity in a temperature increasing step in Present Example 1 or 2.
Figure 12:
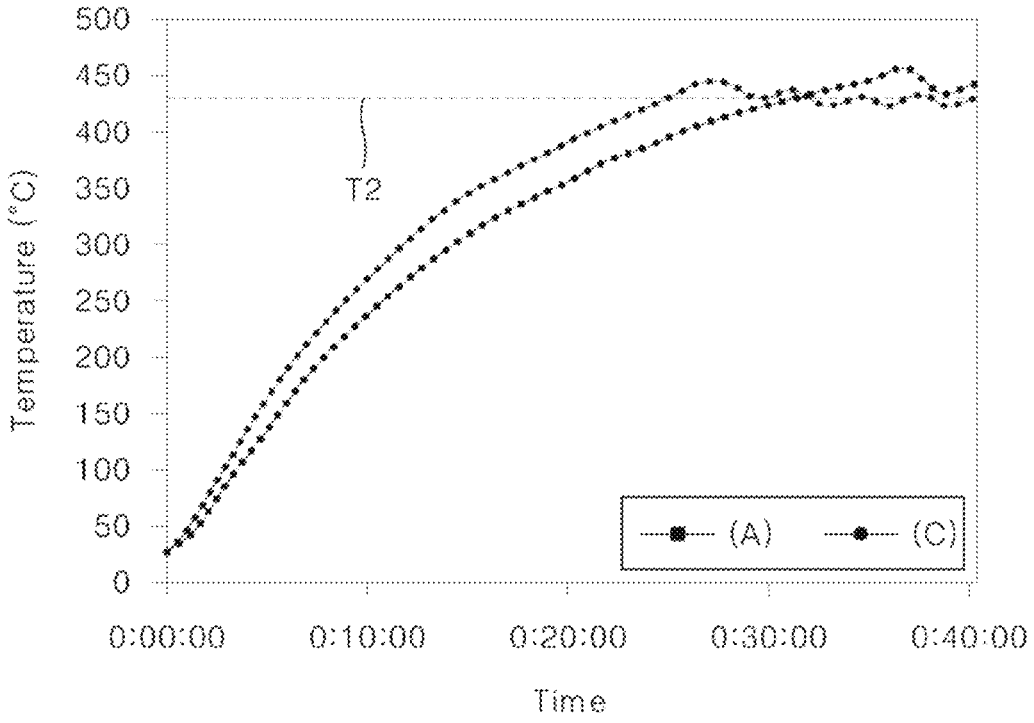
FIG. 12 is a graph to illustrate a temperature change of a cavity in a temperature increasing step in Present Example 3 or 4.
Figure 13:
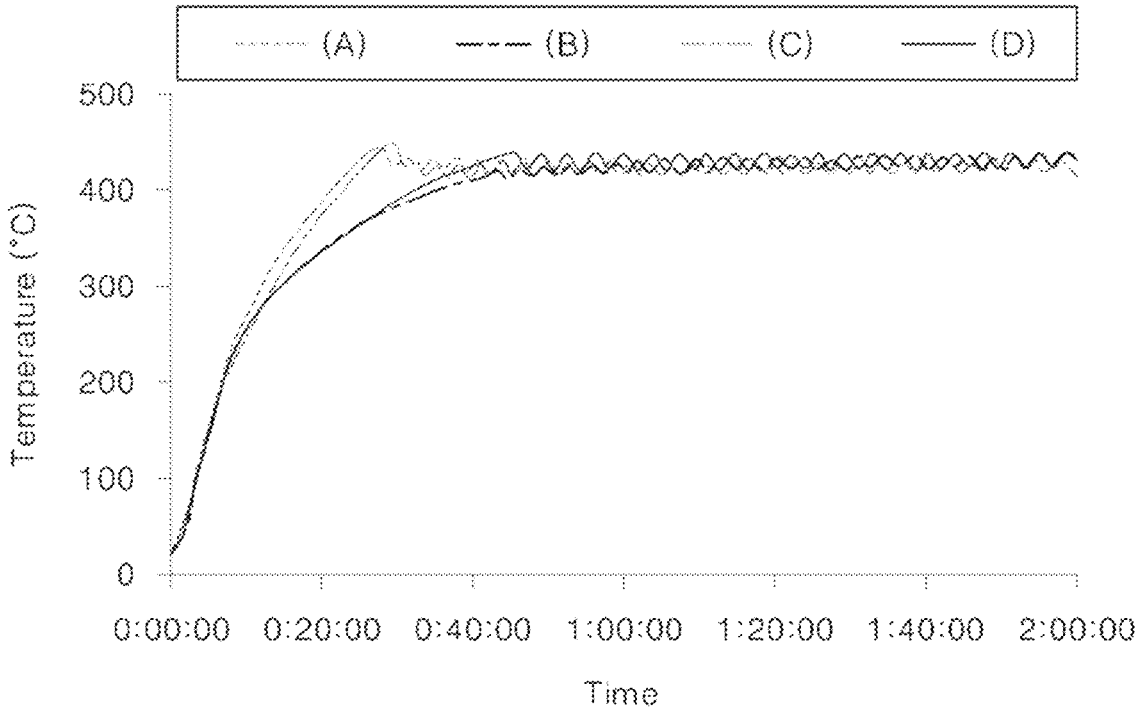
FIG. 13 is a graph to illustrate a temperature change of a cavity according to each present example throughout processes of a self-clean mode.

FIG. 11 is a graph to illustrate the temperature change of the cavity 100 in the increasing the temperature (S200) in Present Example 1 or 2. FIG. 12 is a graph to illustrate the temperature change of the cavity 100 in the increasing the temperature (S200) in Present Example 3 or 4. FIG. 13 is a graph to illustrate the temperature change of the cavity 100 according to each present example throughout the processes of the self-clean mode.

In FIGS. 11 and 12, a graph (A) is a graph showing a temperature change of the cavity 100 in Comparative Example in which the cavity 100 was heated using all of the inner heater 210, the outer heater 220, and the bake heater 300 in succession.

A graph (B) is a graph showing the temperature change of the cavity 100 in Present Example 1 or 2. A graph (C) is a graph showing the temperature change of the cavity 100 in Present Example 3 or 4.

Although the types and operation times of the heaters operating in the increasing the temperature (S200) and in the maintaining the temperature (S300) are different from each other in Present Examples 1 and 2, when the temperature increase rate is consistent in Present Examples 1 and 2, the same graph may be obtained. This is also the same for Present Examples 3 and 4.

A graph (D) is obtained by increasing the temperature of the cavity 100 by Present Example 1 or 2 in the increasing the temperature (S200) and maintaining the temperature of the cavity 100 by Present Example 3 or 4 in the maintaining the temperature (S300).

Referring to FIG. 11, it may be seen that the temperature increase rates or temperature increase percentages of Comparative Example and Present Example 1 are similar to each other up to the increasing the internal temperature of the cavity 100 to a first temperature T1 (S210) in Present Example 1 or Present Example 2. This is because the cavity 100 is heated with an intention of a rapid temperature increase to the first temperature T1 in Present Example 1.

On the other hand, it may be seen that, in the increasing the internal temperature of the cavity 100 to reach the second temperature T2, the temperature increase rate in Present Example 1 or 2 is significantly lower than that in Comparative Example. Accordingly, the thermal decomposition amount of the organic matter may increase in Present Examples 1 and 2 compared to that in Comparative Example.

Referring to FIG. 12, in the increasing the temperature (S200) in which the heating of the cavity 100 starts and the temperature of the cavity 100 reaches the second temperature T2, the temperature increase rate in Present Example 3 or 4 is lower than that in Comparative Example, and a time it takes to reach the second temperature T2 is larger than that in Comparative Example.

Therefore, in Present Example 3 or 4, the thermal decomposition amount of the organic matter may increase compared to that in Comparative Example because of the lower temperature increase rate and the larger temperature increase time compared to those in Comparative Example.

Referring to FIG. 13, when proceeding the self-clean modes according to Present Examples 1 to 4, compared to Comparative Example with the same total time required to proceed the self-clean mode, the thermal decomposition amount of the organic matter may be increased because of the low temperature increase rate and the large temperature increase time.

In addition, as shown in the graph (D), even when Present Example 1 or 2 is performed in the increasing the temperature (S200) and Present Example 3 or 4 is performed in the maintaining the temperature (S300), the thermal decomposition amount of the organic matter may increase compared to that in Comparative Example.

Figure 14:
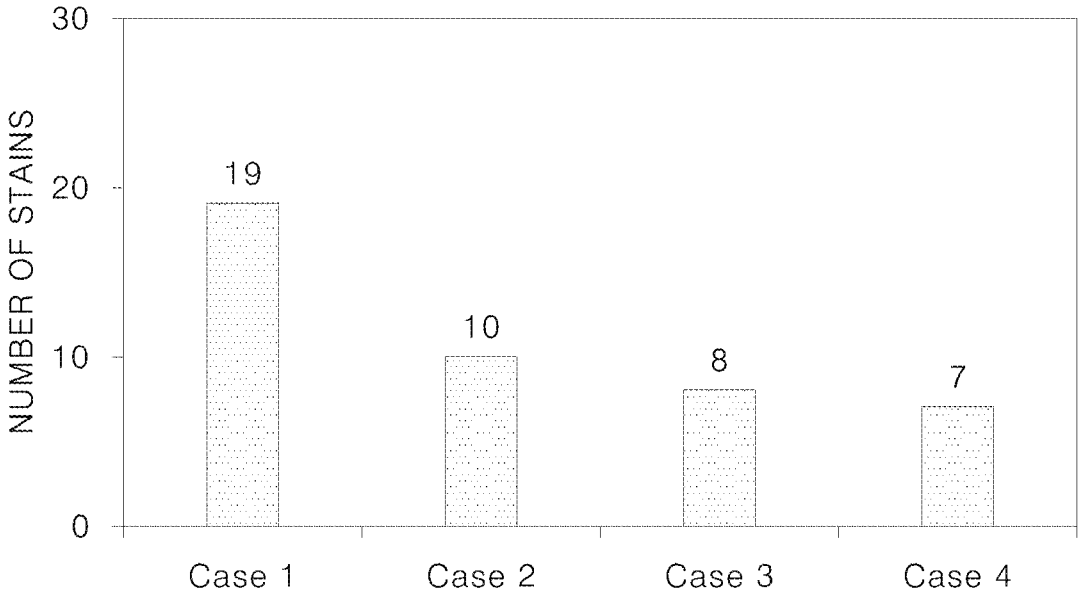
FIG. 14 is a graph to illustrate an effect of a method for controlling cleaning of a cooking appliance according to Present Example.

FIG. 14 is a graph to illustrate an effect of a method for controlling cleaning of a cooking appliance according to Present Example. An experiment was conducted to identify the effect of the method for controlling the cleaning of the cooking appliance according to Present Example.

In the experiment, the same amount of DAO was sprayed onto the bottom plate 410 of the panel 400 for each case, and the self-clean modes were performed in different ways. FIG. 14 shows the number of stains remaining on the bottom plate 410 for each case.

In FIG. 14, Case 1 proceeded the self-clean mode by setting the second temperature T2 to approximately 430° C. and setting the temperature increase rate of the increasing the temperature (S200) to approximately 20° C./min. Case 2 proceeded the self-clean mode by setting the second temperature T2 to approximately 440° C. and setting the temperature increase rate of the increasing the temperature increasing step (S200) to approximately 10° C./min.

In Case 3, the self-clean mode according to Present Example 1 described above was performed, the first temperature T1 was set to approximately 250° C., the second temperature T2 was set to approximately 430° C., and the temperature increase rate of the increasing the temperature (S200) was set to approximately 10° C./min in the increasing the internal temperature of the cavity 100 to a first temperature T1 (S210) and set to approximately 5° C./min in the increasing the internal temperature of the cavity 100 to reach the second temperature T2 (S220).

In Case 4, the self-clean mode according to Present Example 3 described above was performed, the second temperature T2 was set to approximately 430° C., and the temperature increase rate of the increasing the temperature (S200) was set to approximately 5° C./min. In Cases 1 to 4, all of the set times of the self-clean modes were 2 hours.

Experimental results are as shown in FIG. 14. In the self-clean modes according to Present Examples 1 and 3, the numbers of stains remaining on the bottom plate 410 are reduced compared to those in Case 1 and Case 2, indicating that the method for controlling the cleaning of the cooking appliance of Present Example is effective in removing the organic matter.

In particular, in Case 2, the second set temperature was increased by approximately 10° C. compared to those in other cases, so that the power consumption was relatively great, but the number of stains was greater compared to those in Present Example 1 (Case 3) and Present Example 3 (Case 4).

Therefore, it may be seen that the method for controlling the cleaning of the cooking appliance according to the embodiment consumes the less power and has the better removal effect of the organic matter compared to other methods.

In the embodiment, the temperature increase rate of the cavity 100 may decrease in the increasing the temperature (S200). Therefore, while proceeding the self-clean mode, the time for which the temperature of the cavity 100 is maintained at the second temperature T2, which is a maximum temperature, may be reduced.

Therefore, a total heating amount inside the cooking appliance may decrease while proceeding the self-clean mode. As a result, the overheating of the cooking appliance may be suppressed, thereby effectively preventing the fire from occurring in electrical devices and other combustible components disposed in the cooking appliance.

Although the present disclosure have been described with reference to the accompanying drawings, the present disclosure is not limited by the embodiments disclosed herein and drawings, and it is obvious that various modifications may be made by those skilled in the art within the scope of the technical idea of the present disclosure. In addition, although the effects based on the components of the present disclosure are not explicitly described and illustrated in the description of the embodiment of the present disclosure above, it is natural that predictable effects of the corresponding components should also be recognized.

What is claimed is:

1. A method for controlling cleaning of a cooking appliance, the cooking appliance including a cavity configured to accommodate food to be cooked, the cavity including a panel, a broil heater configured to apply radiant heat to the cavity, and a bake heater configured to heat the panel, the method comprising:

selecting a mode including selecting a self-clean mode of the cavity;

increasing an internal temperature of the cavity to a set first temperature and then to a set second temperature; and maintaining the internal temperature of the cavity at the second temperature, wherein the increasing the internal temperature includes controlling a temperature increase rate inside the cavity in the increasing the internal temperature by operating the broil heater and the bake heater alternately, wherein the increasing the internal temperature includes:

increasing the internal temperature of the cavity to the first temperature set lower than the second temperature; and increasing the internal temperature of the cavity to reach the second temperature from the first temperature, wherein a temperature increase rate inside the cavity in the increasing the internal temperature of the cavity to the first temperature is set higher than a temperature increase rate inside the cavity in the increasing the internal temperature of the cavity to reach the second temperature, and wherein, after the internal temperature of the cavity reaches the first temperature, an inner heater of the broil heater and the bake heater alternate outputting heat more frequently than after the internal temperature of the cavity reaches the second temperature.

2. The method of claim 1, wherein the broil heater further includes:

an outer heater disposed at an upper portion of the cavity and surrounding the inner heater, wherein the inner heater is disposed at the upper portion of the cavity, and wherein the outer heater has a maximum heat output capacity that is lower than a maximum heat output capacity of the inner heater.

3. The method of claim 2, wherein the increasing the internal temperature further includes alternately operating the inner heater and the bake heater to control the temperature increase rate inside the cavity.

4. The method of claim 3, wherein in the increasing the internal temperature of the cavity to the first temperature, the inner heater and the bake heater operate in a continuous alternating manner, and wherein in the increasing the internal temperature of the cavity to reach the second temperature, and the inner heater and the bake heater operate alternately with each other and further includes a time period where both the inner heater and the bake heater do not operate.

5. The method of claim 3, wherein in the increasing the internal temperature of the cavity to the first temperature, the outer heater does not operate, and the inner heater and the bake heater operate in a continuous alternating manner, and wherein in the increasing the internal temperature of the cavity to reach the second temperature, the outer heater does not operate, and the inner heater and the bake heater operate alternately with each other, and further includes a time period where both the inner heater and the bake heater do not operate.

6. The method of claim 3, wherein, in the increasing the internal temperature, the inner heater and the bake heater operate in a continuous alternating manner, and an operation time of the bake heater is set larger than an operation time of the inner heater.

7. The method of claim 3, wherein, in the increasing the internal temperature, the outer heater does not operate, and the inner heater and the bake heater operate alternately with each other, and an operation time of the bake heater is set to be longer than an operation time of the inner heater.

8. A method for controlling cleaning of a cooking appliance, the cooking appliance including a cavity configured to accommodate food to be cooked, the cavity including a panel, a heater configured to heat an interior of the cavity, and a controller configured to control the heater, the method comprising:

increasing an internal temperature of the cavity to a set first temperature and then to a set second temperature; and maintaining the internal temperature of the cavity at the second temperature, wherein the increasing the internal temperature includes:

increasing the internal temperature of the cavity to the first temperature set lower than the second temperature; and increasing the internal temperature of the cavity to reach the second temperature from the first temperature, wherein a temperature increase rate inside the cavity in the increasing the internal temperature of the cavity to the first temperature is set higher than a temperature increase rate inside the cavity in the increasing the internal temperature of the cavity to reach the second temperature, wherein the heater includes a broil heater and a bake heater, and wherein, after the internal temperature of the cavity reaches the first temperature, an inner heater of the broil heater and the bake heater alternate outputting heat more frequently than after the internal temperature of the cavity reaches the second temperature.

9. The method of claim 8, wherein the heater includes a plurality of heaters, and wherein in the increasing the internal temperature of the cavity to reach the second temperature, there is a time period where some of the plurality of heaters operating in the increasing the internal temperature of the cavity to the first temperature do not operate.

10. The method of claim 8, wherein the broil heater includes an outer heater disposed at an upper portion of the cavity and surrounding the inner heater, wherein the inner heater is disposed at the upper portion of the cavity, wherein the outer heater has a maximum heat output that is lower than a maximum heat output of the inner heater, and wherein the increasing the internal temperature includes controlling a temperature increase rate inside the cavity by operating the inner heater and the bake heater alternately.

11. The method of claim 10, wherein in the increasing the internal temperature of the cavity to the first temperature, the inner heater and the bake heater operate in a continuous alternating manner, and wherein in the increasing the internal temperature of the cavity to reach the second temperature, the inner heater and the bake heater operate alternately with each other and further includes a time period where both the inner heater and the bake heater do not operate.

12. The method of claim 10, wherein in the increasing the internal temperature of the cavity to the first temperature, the outer heater does not operate, and the inner heater and the bake heater operate in a continuous alternating manner, and wherein in the increasing the internal temperature of the cavity to reach the second temperature, the outer heater does not operate, and the inner heater and the bake heater operate alternately with each other, and further includes a time period where both the inner heater and the bake heater do not operate.

13. The method of claim 10, wherein, in the maintaining the temperature, the inner heater and the bake heater operate in a continuous alternating manner.

14. A method for controlling cleaning of a cooking appliance, the cooking appliance including a cavity configured to accommodate food to be cooked, the cavity including a panel, an inner heater disposed at an upper portion of the cavity, an outer heater disposed at the upper portion of the cavity to surround the inner heater, the outer heater having a maximum heat output lower than a maximum heat output of the inner heater, and a bake heater configured to heat the panel, the method comprising:

increasing an internal temperature of the cavity to a set first temperature and then to a set second temperature; and maintaining the internal temperature of the cavity at the set second temperature, wherein the increasing the internal temperature and the maintaining the internal temperature each include:

operating the inner heater and the bake heater in a continuous alternating manner; and setting an operation time of the bake heater to be longer than an operation time of the inner heater, wherein the increasing the internal temperature includes:

increasing the internal temperature of the cavity to the first temperature set lower than the second temperature; and increasing the internal temperature of the cavity to reach the second temperature from the first temperature, wherein a temperature increase rate inside the cavity in the increasing the internal temperature of the cavity to the first temperature is set higher than a temperature increase rate inside the cavity in the increasing the internal temperature of the cavity to reach the second temperature, wherein a broil heater includes the inner heater and outer heater, and wherein, after the internal temperature of the cavity reaches the first temperature, the inner heater of the broil heater and the bake heater alternate outputting heat more frequently than after the internal temperature of the cavity reaches the second temperature.

15. The method of claim 14, wherein in the increasing the internal temperature and the maintaining the internal temperature, the outer heater does not operate continuously.

16. The method of claim 14, wherein the set first temperature is a temperature at which organic matter decomposes.

17. The method of claim 14, wherein the cooking appliance further includes a convection heater including a fan and a convection unit, wherein the convection heater is disposed at a rear of the cavity, and wherein the fan is configured to circulate air inside the cavity.

* * * * *